US006056608A

United States Patent [19]

Phelan, Sr.

[11] Patent Number: 6,056,608

[45] Date of Patent: May 2, 2000

[54] AIR BOAT

[75] Inventor: John M. Phelan, Sr., Norwich, N.Y.

[73] Assignee: Rivercraft LLC, Norwich, N.Y.

[21] Appl. No.: 09/138,587

[22] Filed: Aug. 21, 1998

[51] Int. Cl.[7] ..... B63H 7/00

[52] U.S. Cl. ..... 440/37

[58] Field of Search ..... 114/355–357, 360, 114/288–290, 62, 219; 440/37

[56] References Cited

U.S. PATENT DOCUMENTS

| | | | |
|---|---|---|---|
| 1,712,758 | 5/1929 | Durand | 440/37 |
| 2,422,818 | 6/1947 | Bamberger | 440/37 |
| 2,695,584 | 11/1954 | Watters | 114/290 |
| 3,500,784 | 3/1970 | Reynolds | 440/37 |
| 3,889,624 | 6/1975 | Balius | 115/42 |
| 3,943,586 | 3/1976 | Palmer | 114/356 |
| 4,214,332 | 7/1980 | Stoner | 114/356 |
| 4,762,080 | 8/1988 | Pearson | 114/219 |
| 4,892,055 | 1/1990 | Schad | 114/357 |
| 5,105,924 | 4/1992 | Carlson | 192/8 R |

*Primary Examiner*—Ed Swinehart
*Attorney, Agent, or Firm*—Salzman & Levy

[57] ABSTRACT

An air boat having a monocoque design is described. The deck and hull are rigidly reinforced with a plurality of formed channels that run parallel along the deck. Side ribs that are disposed perpendicular to the channels provide stiffness in the intersecting plane of the hull. Water-flow channels defined by elongated ribs run along the bottom of the hull and compress water and provide lift to the boat, reducing sideways slippage and spray of the craft during maneuvers and turns. The steering mechanism includes dual fins and a no-feedback gearbox that resists self-straightening when the pilot releases the steering wheel. The turning radius of the boat is especially short. A safety cage is foldable and encloses a motor, the motor mount of which uses the boat hull as its base structural element.

3 Claims, 9 Drawing Sheets

AIR BOAT

FIELD OF THE INVENTION

The present invention relates to water craft that are propelled by air-thrusting mechanisms and, more particularly, to an ultralight air boat having improved stability, performance, and maneuverability by virtue of its unique integral design.

BACKGROUND OF THE INVENTION

Air-thrusting water craft serve unique purposes along water courses that are difficult to navigate by standard water vehicles. The air-thrusting mechanism of these water craft eliminate the need for water guided rudders, centerboards, and water propulsion impellers. In swamps and other shallow water pathways, such projections often foul upon grasses and underwater vegetation, making navigation hazardous and difficult.

Air boats are also known for their ability to traverse through shallow, intricate, and serpentine water courses, by reason of their minimum hull depth below the water line, and their general maneuverability.

The shallow hulls which lack rudder and centerboard, however, make these type of craft hard to handle and control. In operation, such craft have been found to be unstable and subject to capsizing and swamping in rough water, rapids and broken ice. Furthermore, most prior structures lack sufficient flotation and are not readily freed quickly when the craft is run aground in shallow water, muck, mud, ice, snow, or dry land. Movements are generally imprecise. The boats tend to slide sideways in turns and maneuvers. Cross winds tend to push them off course, and spray is kicked up during sharp turns by virtue of the side thrusting.

Moreover, conventional air boats have steering systems—often with "stick" controls—that return to center position, self-straightening due to propwash when the pilot releases control of the stick. In many situations, however, this tendency is neither desired nor especially safe, as control of the boat is comprised.

The center of gravity of conventional air boats is high, due to the height of the propeller axis and engine mount above the boat deck. The engine and propeller usually sit several feet above the deck surface. The high center of gravity exacerbates the sloppy handling and control. Another problem is that overall prior air boat height, generally 8'–10', restricts boat usage and storage in low clearance areas. In addition, the general smoothness and shallowness of the hull provides little resistance to side forces, which act to propel the craft sideways. It is not unusual for such conventional air boats to have long turning radii.

The flexibility of the hulls of the air boats also causes fatigue, resulting in cracks and structural failure. Conventional air boat polymer bottom design, using one or more large pieces below the hull, can tear apart and scoop surface material, which immobilizes or severely slows the craft.

The current invention endeavors to provide an air boat that generally eliminates or substantially reduces all of the aforementioned disadvantages. The present invention seeks to provide an air boat that is precisely maneuverable, has improved handling, and which is less influenced by side thrusting forces. The air boat's light weight aids the pilot in freeing the boat if it runs aground. The boat itself has sufficient structural integrity to survive impacts over a long period of time.

The invention features an air-thrusted craft that has an improved hull, deck, and thrusting design. The deck is constructed with rigid formed aluminum channels and members or side ribs that reduce structural flexibility of the hull during turns and maneuvers. The bottom of the hull is provided with a plurality of substantially parallel channels, which greatly reduce sideways slide, and which reduce spray kick-up during sharp turns. Since the dual steering fins are capable of moving more than 45°, the boat has a very short turning radius.

The motor and multi-blade propeller of the thrusting mechanism are lightweight, and are mounted in a smaller cage. In fact, the motor mount uses the boat hull itself for its base structural element and the cage is set lower to the deck surface. This greatly improves the center of gravity, by lowering it, relative to the water line of the boat. Hollow panels disposed in the hull are filled with rigid foam to improve buoyancy in case of partial submergence. Hull parts are welded instead of riveted, to provide a uniformly contiguous, frameless design. The hull bottom is coated with polyethylene or PTFE to improve hull water friction, resistance to abrasion, and freedom from freezing to ice.

It is an object of this invention to provide an improved air boat.

It is another object of the invention to provide an air-thrusted water craft having improved handling and control.

Another object of this invention is to provide a novel surface craft adapted to be propelled on land, marsh, ice, snow and rough water surfaces.

A further object of this invention is to provide a novel surface craft having increased stability and safety when operating in rough water and rapids.

A further object of this invention is to provide a novel surface craft which is light and slippery enough to be freed quickly when the craft has run aground in shallow water, muck, mud, snow, ice or dry land.

An additional object of the present invention is to provide an air boat with a relatively short overall boat height to allow the boat to access low clearance areas.

Another object of this invention is to adhere multiple strips of a high strength polymer to the bottom of the hull such that damage to the polymer does not immobilize or significantly slow the craft.

A further object of this invention is to provide sufficient flotation such that the craft floats level when filled or partially filled with water.

A still further object of this invention is to provide an air boat with a relatively low center of gravity to provide better maneuverability, compared to prior conventional air boat structures.

It is a further object of this invention to provide an air boat, the hull of which comprises an overall one-frame construction for increasing usable area and decreasing weight without sacrificing material strength.

It is yet another object of the invention to provide an air boat having a fold-down safety cage.

It is yet another object of the invention to provide an air boat having one or more steerable fins connected to a non-feedback steering mechanism.

It is yet another object of the invention to provide an air boat having a steering mechanism incorporated in universally familiar controls, which steering mechanism allows the boat to turn in a short turning radius.

It is yet another object of the invention to provide an air boat being fabricated of ultralight components and having improved buoyancy characteristics.

SUMMARY OF THE INVENTION

In accordance with the present invention, there is provided an air-thrusted water craft having superior maneuverability and handling. The deck of the air-thrusted craft is strengthened with a plurality of substantially parallel formed channels running lengthwise along the boat hull. The channels provide rigidity to the deck and boat frame. Interior and side ribs disposed substantially perpendicular to the channels further improve the structural stiffness of the hull during turns and maneuvers.

The bottom of the hull is provided with substantially parallel water-flow channels, which greatly reduce sideways slide and increase lift. The thrusting motor and propeller are lightweight, mounted in a smaller cage at the rear of the craft. The cage is set lower to the deck surface, which helps lower the center of gravity of the boat. Hollow panels disposed in the hull are filled with rigid foam to improve buoyancy during partial submergence, which safely allow the boat to survive being swamped. Hull parts are welded instead of riveted, to provide a uniformly contiguous, frameless or monocoque design. The exterior bottom surface of the hull is coated with polyethylene or PTFE to reduce hull water friction, resistance to abrasion, and freedom from freezing to ice.

The steering mechanism includes dual fins and a no-feedback linkage that eliminates self-straightening when the pilot releases the steering wheel. The turning radius of the boat is especially short. A safety cage is foldable and encloses a motor, the motor mount of which uses the boat hull as its base structural element.

BRIEF DESCRIPTION OF THE DRAWINGS

A complete understanding of the present invention may be obtained by reference to the accompanying drawings, when considered in conjunction with the subsequent detailed description, in which.

For purposes of clarity and brevity, like elements and components of the air boat of this invention, shall bear the same designation and numbering throughout the figures.

DESCRIPTION OF THE PREFERRED EMBODIMENT

Figure 1:
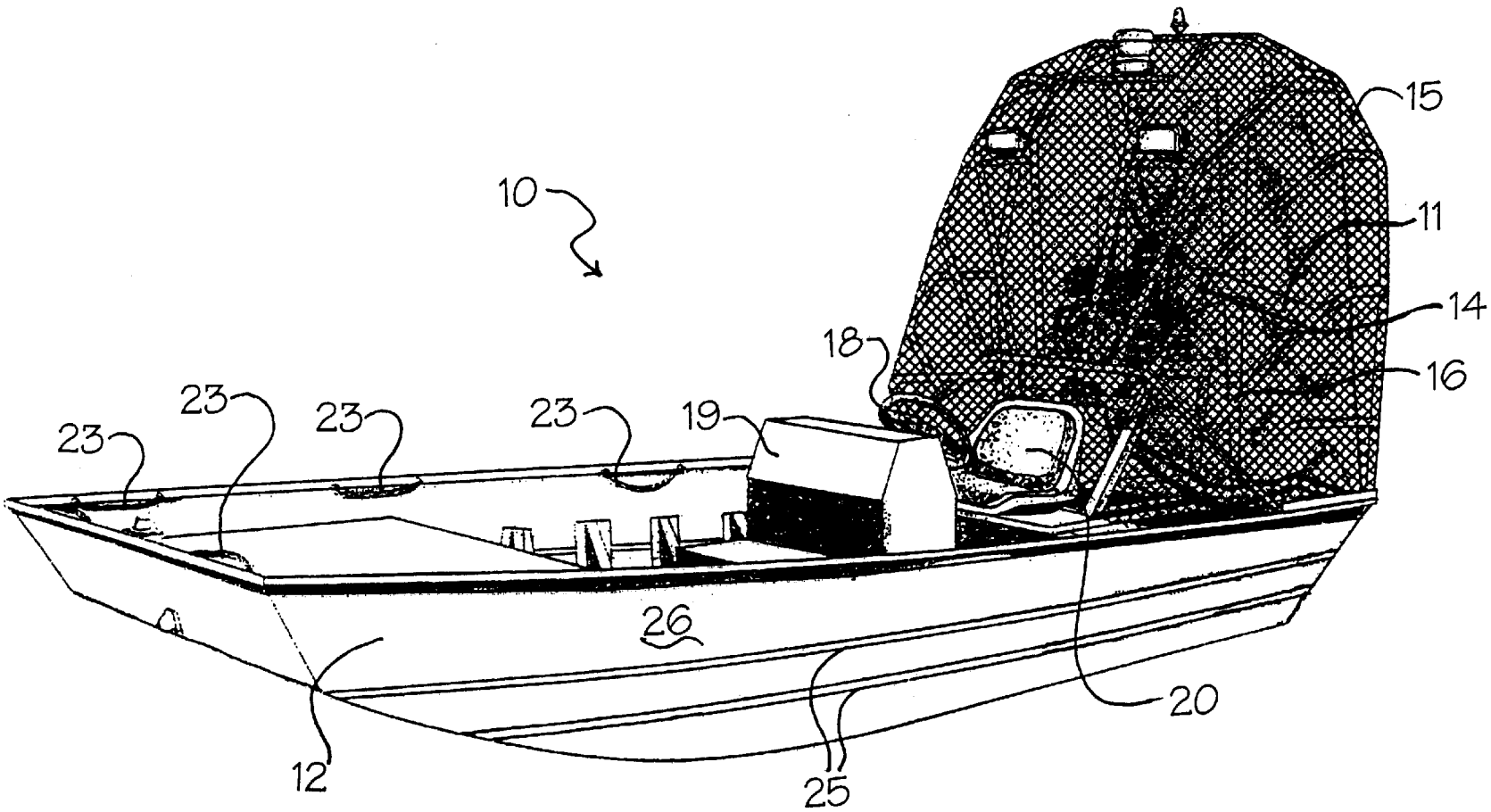
FIG. 1 illustrates a right-handed perspective view of the air boat of this invention.

Generally speaking, the invention features an air boat having a monocoque construction. The deck is rigidly reinforced with a plurality of formed channels that run parallel along the deck. Side and bottom ribs, disposed perpendicular to the channels, provide stiffness in the intersecting plane of the deck and side walls. The water-flow channels that run along the bottom of the deck (i.e., the hull) direct water past the boat, reduce sideways slippage of the craft during maneuvers and turns, and increase lift, reducing spray.

Now referring to FIGS. 1 through 8, the air boat 10 of this invention is illustrated in perspective views. The air-thrusted water craft comprises a monocoque structure. A hull 12 comprises lightweight aluminum, but can also be fabricated from other lightweight, rigid materials. The air boat 10 is propelled by an air-thrusting propeller 11 driven by an ultra-lightweight aircraft engine 14, such as Model No. G50C, manufactured by Komatsu Zenoah Corp. The engine 14 is mounted by means of a motor mount 52 that uses the hull 12 for its base structural element. In other words, motor mount 52 gains great strength by using the boat hull 12 as its base structure. In this way, localized hull stresses are distributed over a wider area of the hull 12 by passing them through the motor mount 52, thus increasing overall stiffness and strength. Four longitudinal, aluminum members 54 are welded to brackets 56. Brackets 56 are fastened to transom 58 by bolts 60. These longitudinal members 54 are attached to seat supports 20*a* and seat base 20*b* by bolts 62. Motor mount vertical members 64 are bolted via bolts 68, to hull gussets 66. The low slung, truncated frame 16 that sits within a protective cage 15 is covered with buoyant plastic mesh. The lightness of the engine 14 and the lightweight propulsion blades 11, made of a Kevlar composite with inlaid nickel steel leading edge, provide a low center of gravity, which is approximately at the level of the gunnel 13. Once manned by an operator/pilot and passengers, not shown, the center of gravity is even lower.

A seat 20 for the pilot and speed controls 21 disposed adjacent seat 20 are mounted behind the console 19. The console 19, seat 20, and speed controls 21 are mounted to the deck 24, as best observed with reference to FIG. 7.

Figure 2:
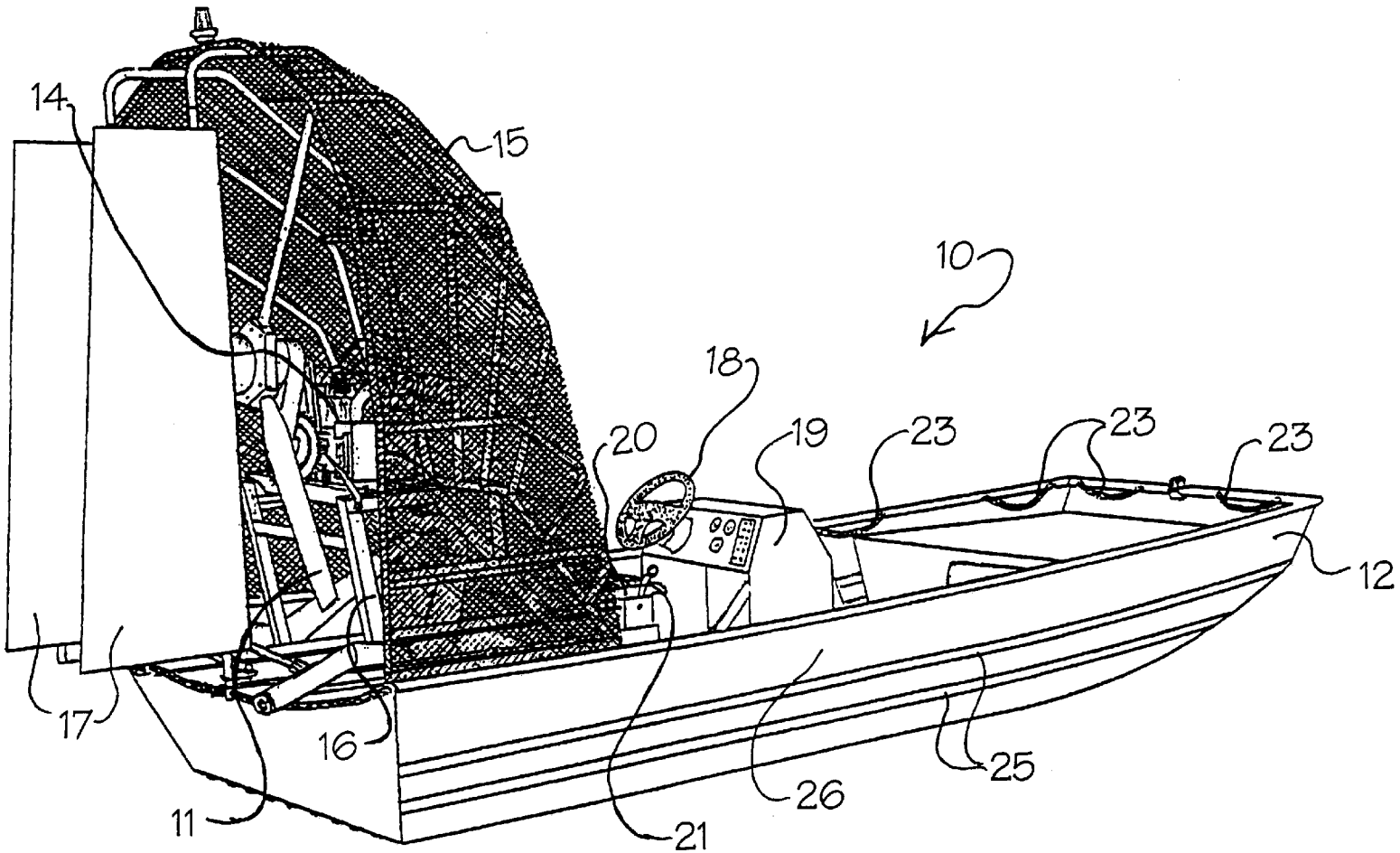
FIG. 2 depicts a left-handed perspective view of the air boat, shown in FIG. 1.
Figure 2A:
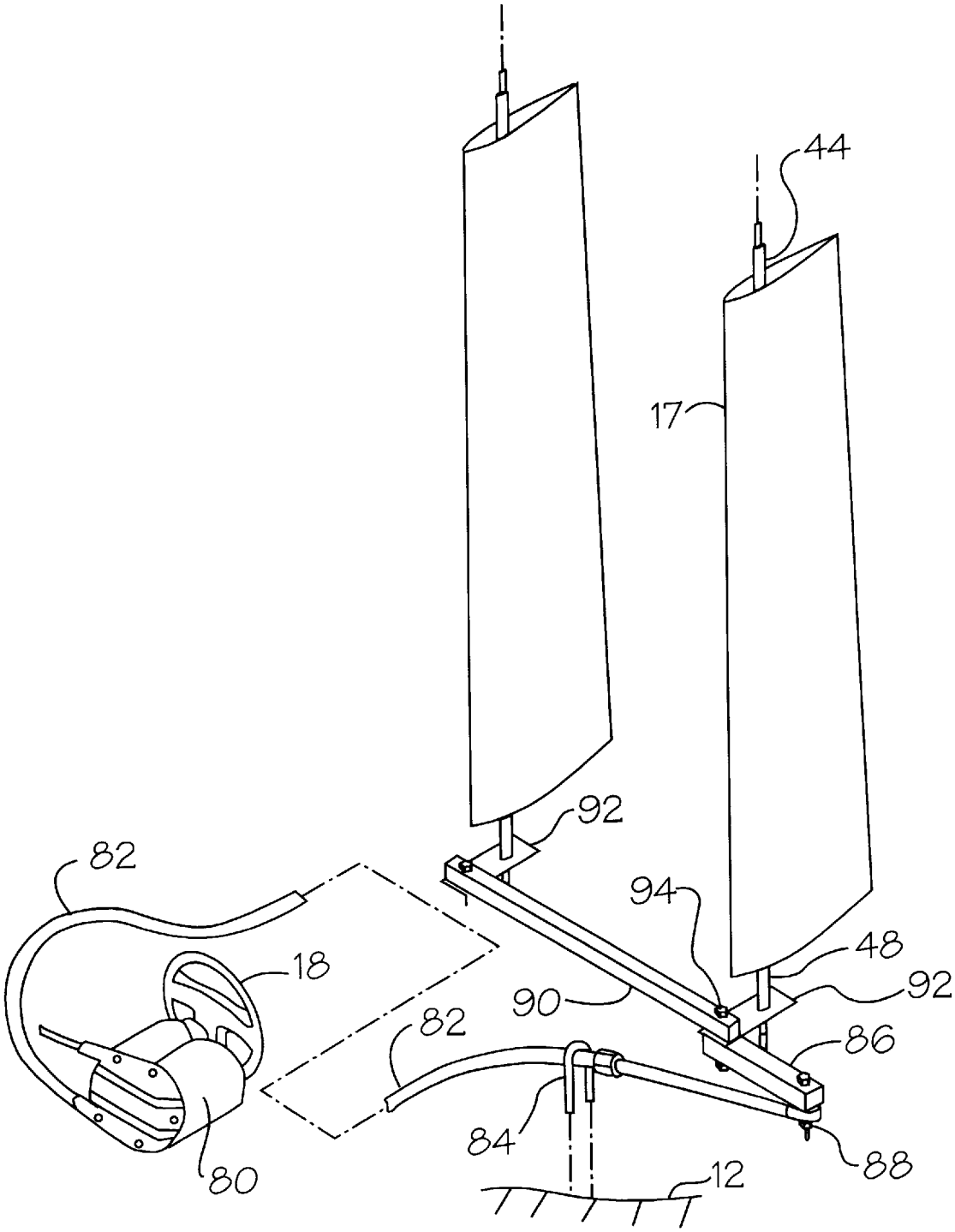
FIG. 2A is a schematic representation of the steering linkage of the air boat.

The boat 10 is steered by means of the twin, parallel, rear steering fins 17, that are guided by the steering wheel 18, mounted upon the center control panel console 19. As best shown in FIG. 2A, steering wheel 18 is connected to a no-feedback steering box or gearbox 80, such as Model No. NFB manufactured by Teleflex Marine, Inc. and described in U.S. Pat. No. 5,105,924, issued to Carlson and hereby incorporated by reference. Gearbox 80 has reduction gearing and a clutch, not shown, which inhibits the cable 82 from rotational movement until turning force is applied by the steering wheel 18. Thus, gearbox 80 actuates steering fins 17 and also prevents self-straightening after the turning force is removed. That is, the friction created by the clutch mechanism of gearbox 80 is greater than the self-straightening force of the propwash against the steering fins 17. In this way, the steering mechanism of the boat 10 is a no-feedback system. The gearbox 80 is connected to steering fins 17 by a push-pull cable 82, fastened to hull 12 by a U-bolt 84. Cable 82 converts rotational movement of the steering wheel 18 into linear movement, as required by a steering link 86 to which it is attached. Cable 82 is attached to steering link 86 by pivot bolt 88. This steering link 86 is attached to steering bracket 92, which, in turn, is affixed to steering fin 17. A tie rod 90 connects the two steering fins 17 together, by means of bolts 94.

Figure 2B:
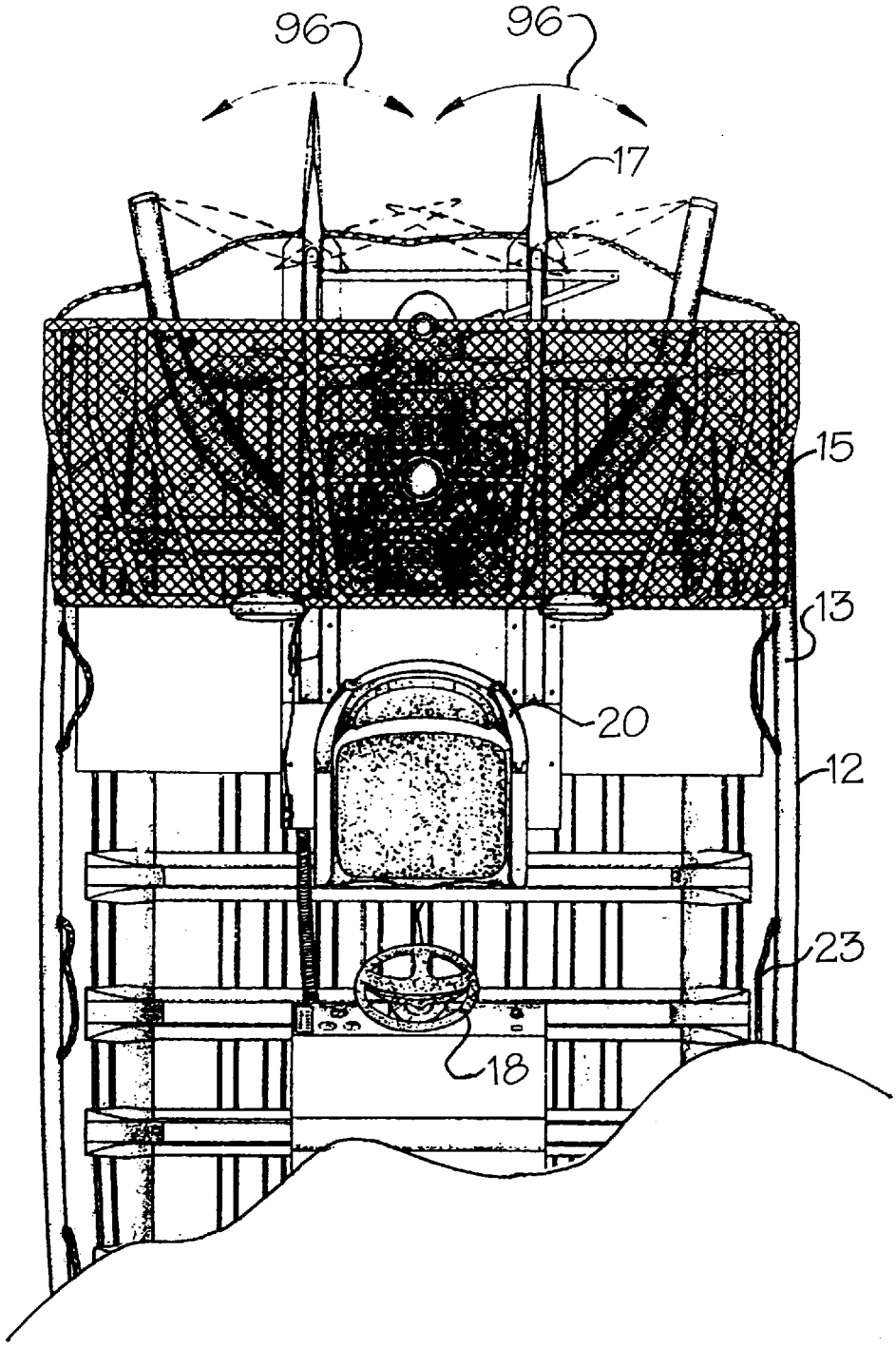
FIG. 2B is a top view of the aft section of the air boat, including steering fins.

Dual steering fins 17 are capable of moving more than 45°, and preferably approximately 70° in both directions from the perpendicular axis thereof, as shown by arrows 96 (FIG. 2B), providing an unusually short turning radius compared to conventional boats of which fins can typically move no more than 22½° in either direction. The short turning radius of the inventive boat 10 is also made possible due to the improved stability of the hull 12, hereinbelow described.

The overall boat profile is reduced in height, for purposes of storage or accessing restricted spaces, by releasing fasteners 40 from cage 15. Cage 15 pivots forward (arrow 41) on bolt pivots 42. This movement of cage 15 frees upper nylon spindles 44 attached to top of steering fins 17 and inserted into a tube 46 of cage 15. Fins 17 remain standing on boat 10, supported by lower nylon spindles 48 and steering bracket 92. Fins 17 may now be removed from the boat 10 by lifting them vertically.

The total weight of the boat 10 and engine 14 is approximately 660 lbs. The boat 10 can be easily lifted and carried from a trailer (not shown). Rope handles 23 (FIGS. 1, 2, and 7), which are part of a continuous line, are accessible at various positions along the hull gunnel 13. In other words, the perimeter carry/attachment line 23 is installed inside the gunnel 13 of the boat 10. This line 23 exits the gunnel 13 at selected locations to facilitate physical movement of the craft and to provide multiple attachment points. Such handles 23 are provided, for example, for lifting, guiding and carrying the boat 10, as well as for securing equipment and personnel thereto.

The air boat 10 has reinforcing spray rails 25 running lengthwise along the side walls 26 of hull 12, as shown in FIGS. 1 through 5.

Figure 4:
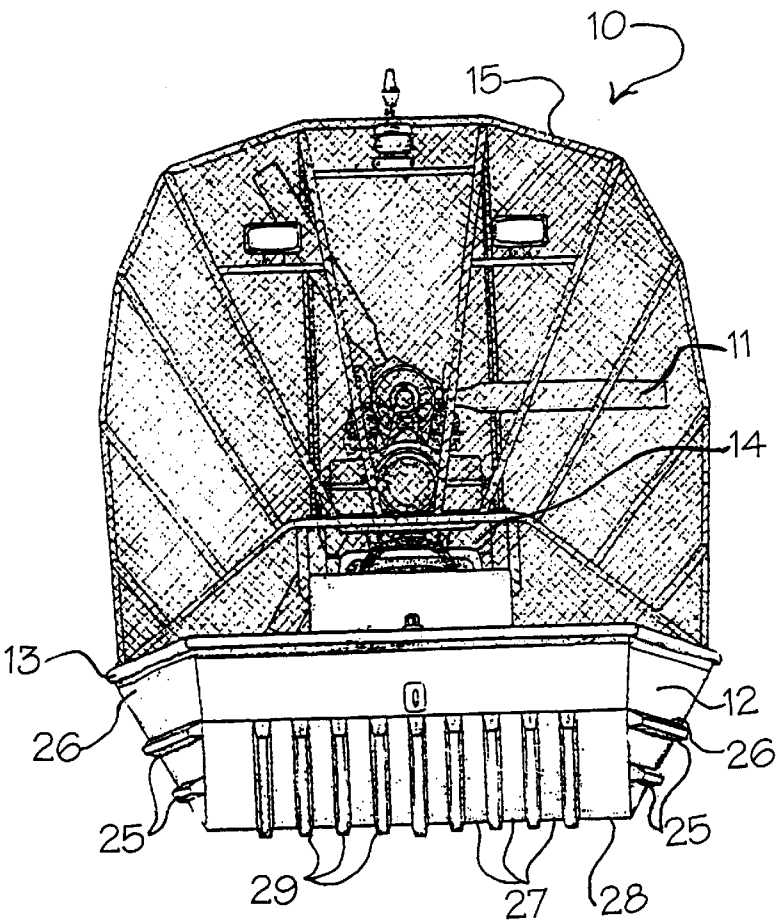
FIG. 4 depicts a front view of the air boat, shown in FIG. 1.
Figure 3:
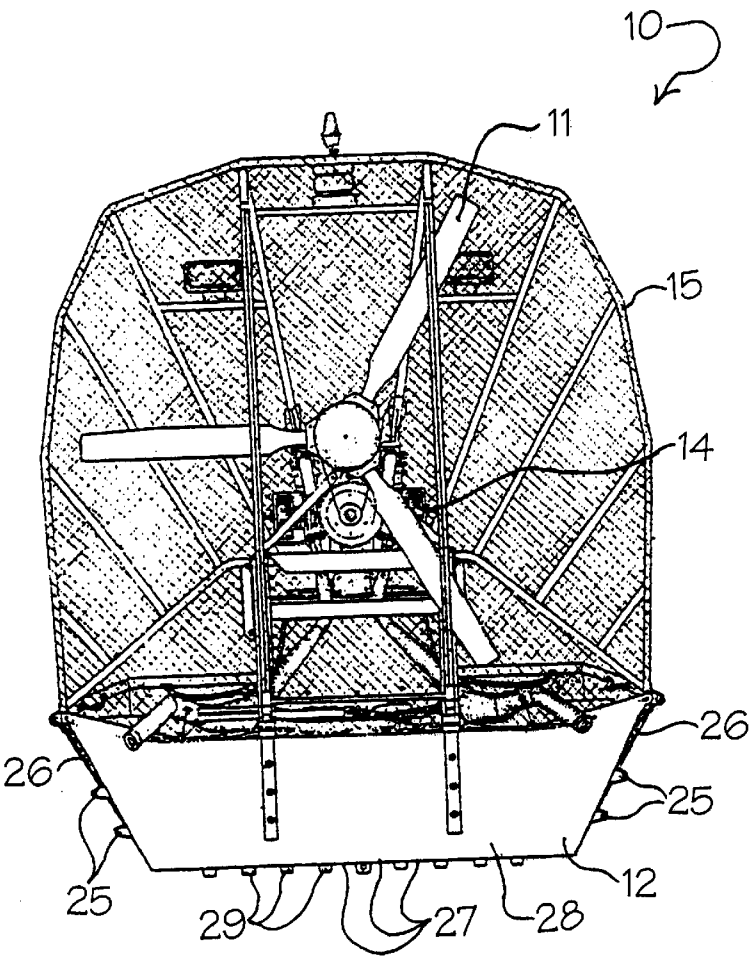
FIG. 3 shows a back view of the air boat, illustrated in FIG. 1.
Figure 5:
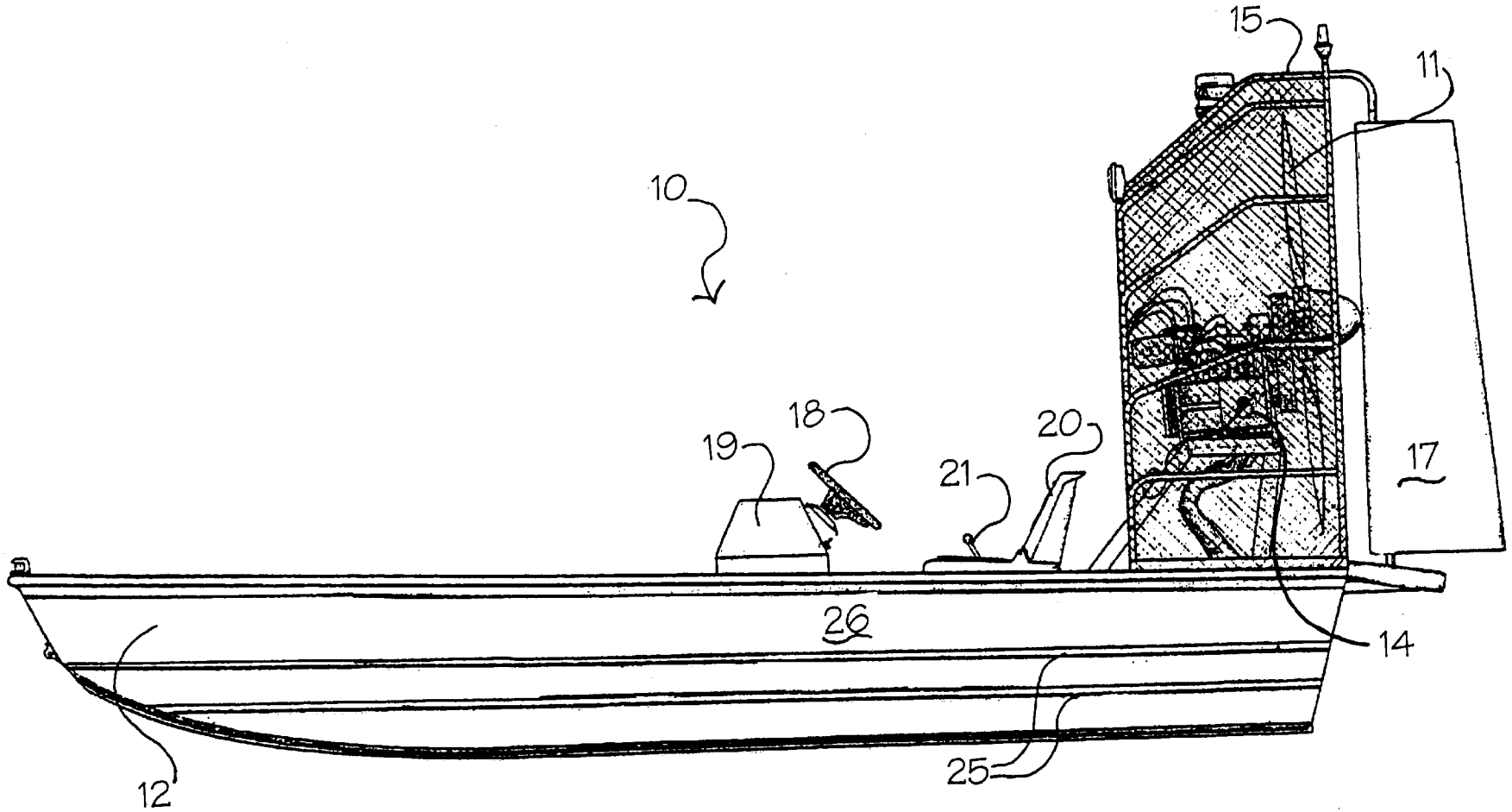
FIG. 5 illustrates a side view of the air boat, shown in FIG. 1.
Figure 6:
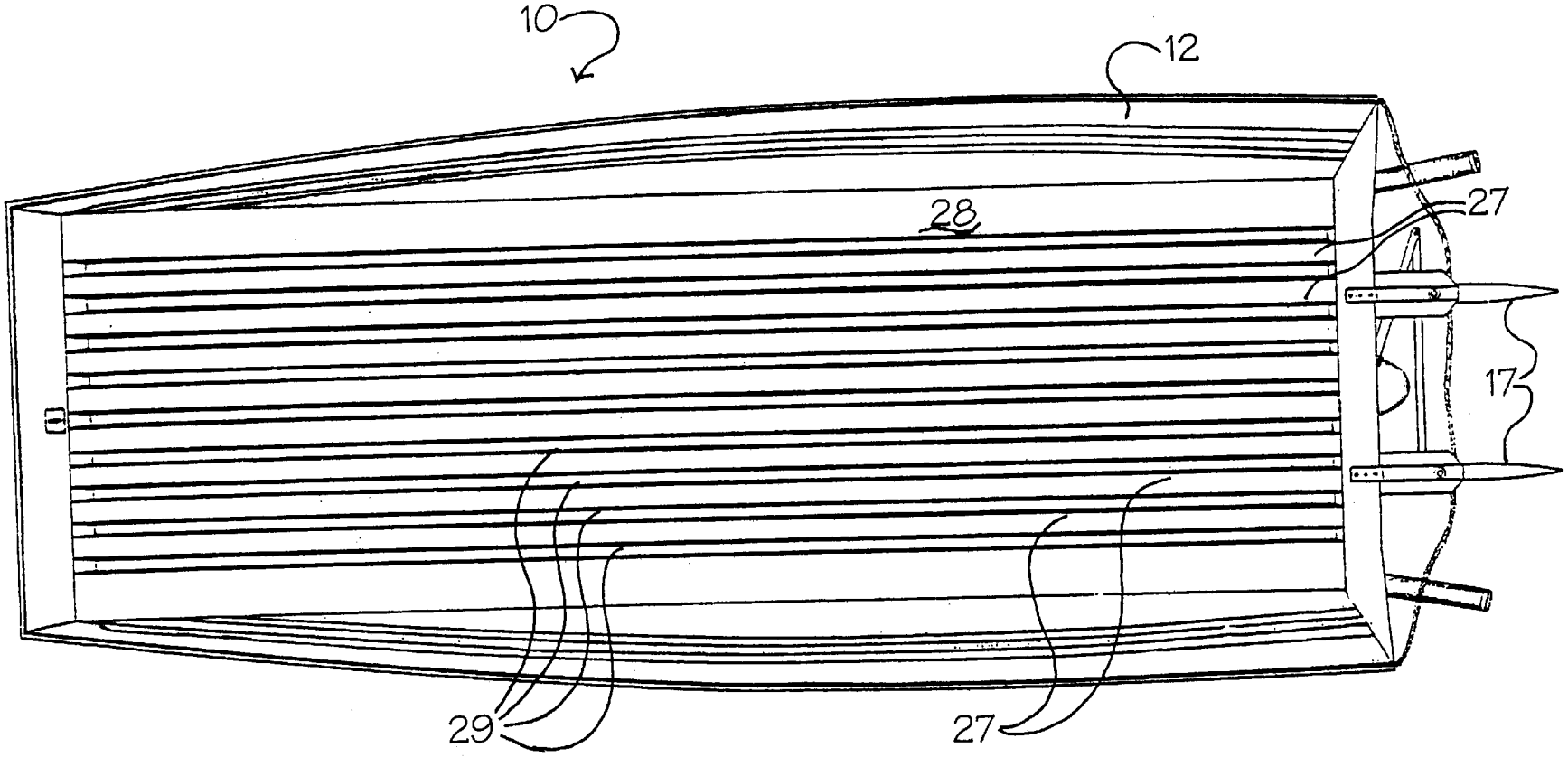
FIG. 6 shows a bottom view of the air boat, illustrated in FIG. 1.
Figure 7:
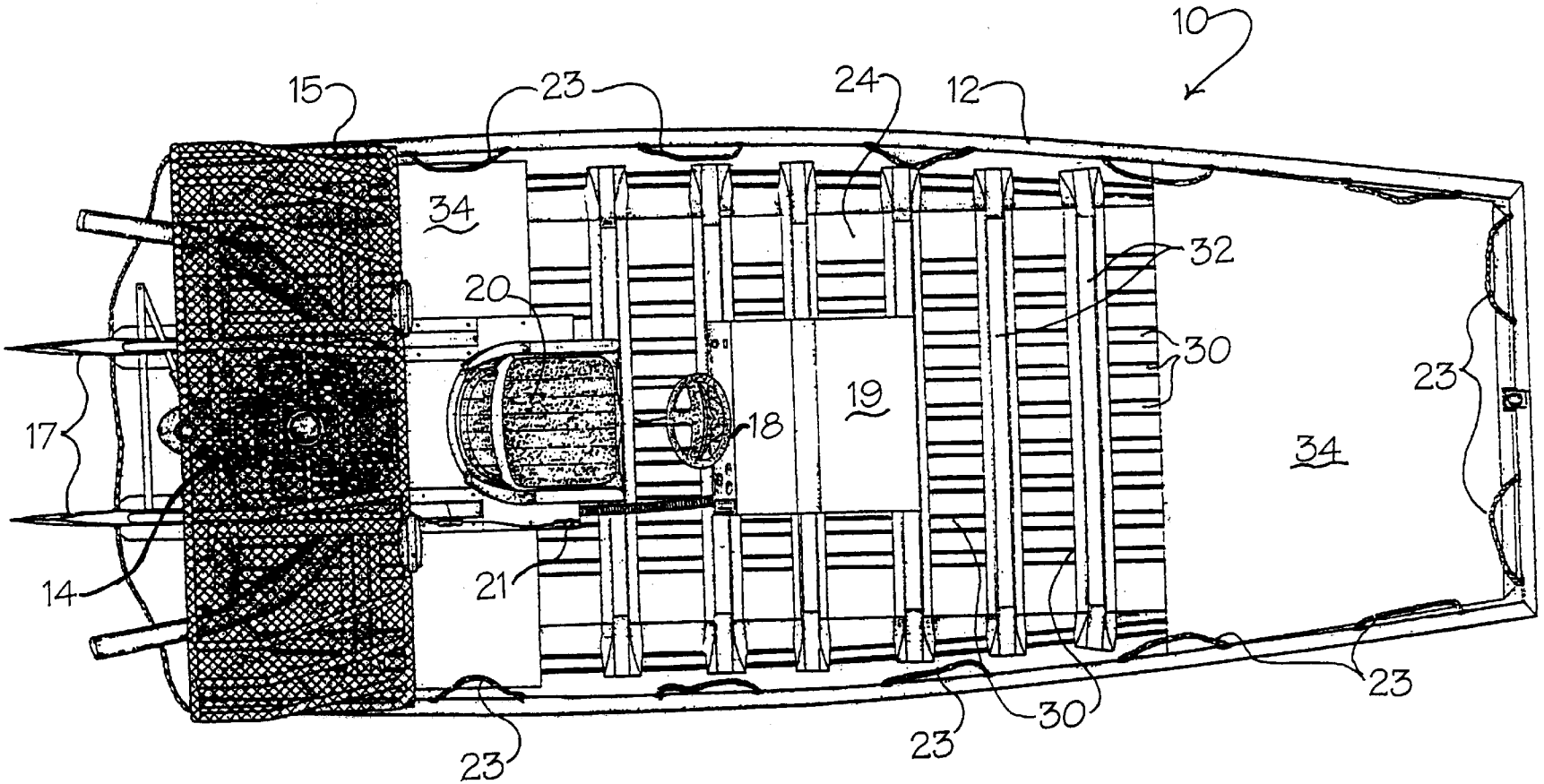
FIG. 7 depicts a top view of the air boat, shown in FIG. 1.
Figure 8:
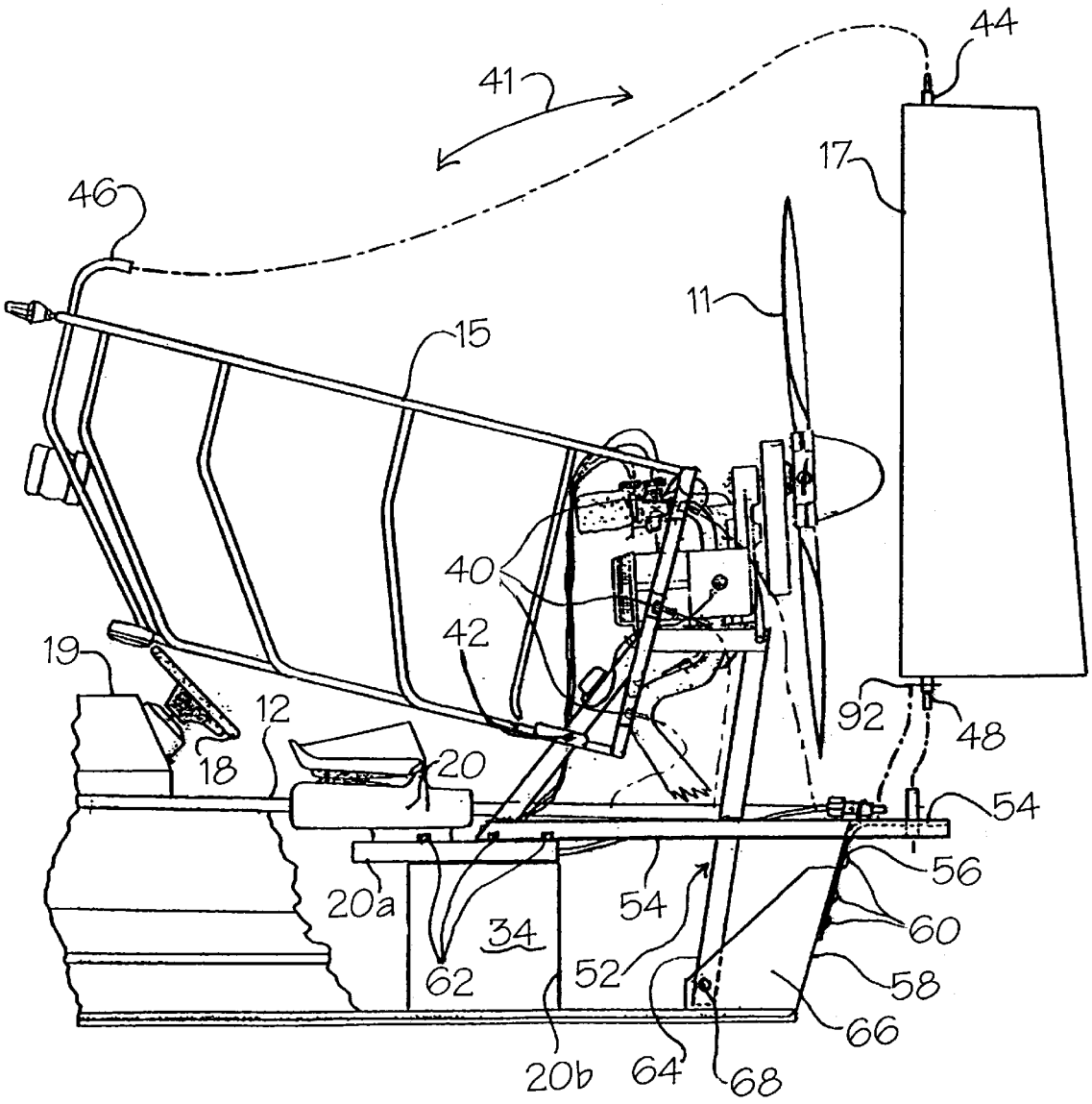
FIG. 8 depicts a cross sectional view of the folding cage and motor mount of the present invention.

Water-flow channels 27, disposed on the bottom 28 of the hull 12, as best observed with reference to FIGS. 3, 4, and 6, provide the boat 10 with improved stability, control, and maneuverability in turns and sharp cornering. The water-flow channels 27 result from the elongated formed channels 29, that run lengthwise along the bottom 28 of hull 12. The water-flow channels 27 cause water to compress, and provide lift to the boat 10, thus increasing speed, planing ability, and maneuverability. The formed channels 29 substantially reduce side-to-side slippage and spray, so often common with conventional air boats.

The bottom 28 of the hull 12 (FIG. 6) is coated with strips of high strength polymer, longitudinally adhered thereto, fabricated of polyethylene or PTFE to decrease frictional effects between the water and the hull 12 and to improve abrasion resistance and freedom from freezing to ice. Each polymer strip is field replaceable and individually disposable. The possibility of catastrophic polymer failure inherent in conventional polymer bottom designs is therefore substantially eliminated, as no piece of polymer is large enough to significantly impair performance. Hollow sections 34 can contain air-containing rigid foam or other buoyant materials in order to improve the buoyancy of the water craft 10, if swamped.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An air-thrusted vehicle for traversing wet or icy surfaces, such as shallow water, muck, mud, ice, snow or dry land, comprising:

a hull having a deck disposed thereupon;

air-thrusting propulsion means operatively connected to the deck of said hull; and a cage pivotally and operatively connected to said deck, said cage enclosing said air-thrusting propulsion means and being adapted to fold downwardly towards said deck to reduce the profile of said vehicle.

2. The air-thrusted vehicle in accordance with claim 1, wherein said air-thrusting propulsion means is integrally mounted to said deck, said deck forming a bottom structure of said air-thrusting propulsion means.

3. The air-thrusted vehicle in accordance with claim 1, said vehicle having a gunnel and said air-thrusting propulsion means having a center of gravity, said center of gravity being approximately at a level of said vehicle gunnel.

* * * * *